US005596820A

United States Patent [19]

Edauw et al.

[11] Patent Number: 5,596,820

[45] Date of Patent: Jan. 28, 1997

[54] ADJUSTABLE SHELL FOR SPORTS SHOES

[75] Inventors: Peter Edauw, Camalo' Di Povegliano, Italy; Carey Portzline, St. Louis Park; Timothy Wiener, Minnetonka, both of Minn.

[73] Assignees: Nordica S.p.A., Trevignano, Italy; Rollerblade, Inc., Minnetonka, Minn.

[21] Appl. No.: 427,136

[22] Filed: Apr. 24, 1995

[30] Foreign Application Priority Data

Apr. 26, 1994 [IT] Italy ..... TV94A0041

[51] Int. Cl.[6] ..... A43B 5/04; A43B 5/16

[52] U.S. Cl. ..... 36/115; 36/117.1; 36/119.1

[58] Field of Search ..... 36/115, 3 R, 3 A, 36/11.5, 54, 77 R, 8.4, 97, 117–121, 114, 7.7, 7.5, 45, 50.1, 50.5, 117.1, 119.1

[56] References Cited

U.S. PATENT DOCUMENTS

| | | | |
|---|---|---|---|
| D. 87,016 | 5/1932 | Meyer | 36/11.5 |
| D. 94,638 | 2/1935 | Stritter | 36/11.5 |
| 1,805,728 | 5/1931 | Sohn | 36/11.5 |
| 1,949,318 | 2/1934 | Markowsky | 36/3 A |
| 4,622,763 | 11/1986 | Adams | 36/50.1 |
| 5,171,033 | 12/1992 | Olson et al. | 280/11.22 |
| 5,226,246 | 7/1993 | Soo | 36/50.1 |
| 5,243,772 | 9/1993 | Francis et al. | 36/45 X |

FOREIGN PATENT DOCUMENTS

| | | |
|---|---|---|
| 0551704 | 7/1993 | European Pat. Off. . |
| 2691885 | 12/1993 | France . |
| 9100746 | 4/1991 | Germany . |
| 8101359 | 5/1981 | WIPO . |

*Primary Examiner*—B. Dayoan

*Attorney, Agent, or Firm*—Welsh & Katz, Ltd.

[57] ABSTRACT

A shell, particularly for sports shoes such as ice skates or roller skates or trekking boots. The shell includes a single body that has a first flap and a second flap, at least one of which is arranged transversely to the foot instep. A single fastening device can be arranged between the first and second flaps. The first and second flaps are connected along two directrices that are oblique with respect to the toe and heel regions. This configuration allows to reduce the number of shell closure levers, nonetheless ensuring optimum securing of the foot inside the shell.

18 Claims, 2 Drawing Sheets

ADJUSTABLE SHELL FOR SPORTS SHOES

BACKGROUND OF THE INVENTION

The present invention relates to a shell, particularly for sports shoes such as ice skates, roller skates, or trekking boots.

Conventional sports shoes, such as ice skates or roller skates, usually comprise a shell made of plastics, inside which an innerboot, made of soft material for the user's comfort, is to be internally associated.

An inconvenience of these conventional shoes is that the shell is open at the metatarsal region and at the foot instep region and therefore requires two or more fastening devices, constituted by levers, which allow to move the flaps of the shell closer to each other and then fasten them so as to secure the innerboot that can be positioned in the shell and consequently secure the foot that is accommodated in the innerboot.

Accordingly, the use of two or more levers causes an increase in the manufacturing costs of the shoe and increases the overall weight of the shoe. Furthermore the user has to perform several operations in order to fasten the shell or remove the foot from the innerboot.

U.S. Pat. No. 5,171,033 discloses an in-line skate having a shell in which multiple ventilation openings are formed. The edges of said openings are mutually connected by two levers which are arranged transversely to the foot instep regions.

European patent no. 0 551 704 discloses an in-line skate having a removable shoe in which, as a partial solution to the above mentioned drawbacks, the shell is substantially open at the foot instep and metatarsal regions and is provided, only at the toe region, with an element that partially and externally surrounds an innerboot along a direction that is oblique with respect to the longitudinal axis of the wheel supporting frame.

A cuff is articulated to said shell and has a single lever for fastening its flaps at the tibial region.

However, even this solution has drawbacks: the coupling between the innerboot and the shell is not optimum, because the considerable forces transmitted by the foot to the wheel supporting frame can lead to an unintentional disengagement of the innerboot with respect to the shell at the toe region, thus making sports practice dangerous.

Another known in-line skate has a shell formed by two parts: one part is associated with the wheel supporting frame and constitutes a supporting base for the sole and for part of the lateral regions of an innerboot, and the second part, constituted by a tongue, is pivoted transversely at the tip region of the first element, which affects the entire upper part of the foot and part of the tibia.

Said tongue interacts, in the tibial region, with an adapted lever that surrounds, to the rear, a cuff that is articulated to the first part approximately in the malleolar region.

However, even this solution has drawbacks, because it requires the use of a retention element in the foot instep region; said element is constituted by a detachable fastening band constituted for example by material known by the trade-name "Velcro".

In any case, optimum securing of the innerboot is not achieved, and accordingly the transmission of forces from the foot to the wheels is not optimum. This is due, in particular, to the fact that the tongue, made of substantially rigid material, is in contact with the innerboot only in the foot instep region, where it is pressed by the fastening band, and that gaps form, however, between the innerboot and said tongue towards the toe region and therefore allow the innerboot to move with respect to the shell during skating: this relative motion produces ineffective transmission of forces, leading to difficulty in controlling the skate.

SUMMARY OF THE INVENTION

The aim of the present invention is therefore to solve the described technical problems, eliminating the drawbacks of the prior art, by providing a shell that allows optimum transmission of forces from the foot, with the optional interposition of a soft innerboot, to the shell itself, and has low manufacturing costs.

Within the scope of the above aim, an important object is to provide a shell in which the user needs to perform a single operating step to secure or release the foot.

Another important object is to provide a shell that has a modest weight with respect to the prior art.

Another object is to provide a shell that is reliable and safe in use, allows to transmit even the lateral thrusts of the foot in an optimum manner, and can be manufactured with conventional machines or equipment.

This aim, these objects, and others which will become apparent hereinafter are achieved by a shell, in particular for sports shoes such as ice skates or roller skates or trekking boots, characterized in that it comprises a single body having a first flap and a second flap, at least one of said flaps being arranged transversely to the foot instep, a single fastening device being arrangeable between said flaps, either one of said first and second flaps being connected along two directrices that are oblique with respect to the toe and heel regions.

Advantageously, the shell has fit adapting means in the toe region.

BRIEF DESCRIPTION OF THE DRAWINGS

Further characteristics and advantages of the invention will become apparent from the detailed description of two preferred but not exclusive embodiment, illustrated only by way of non-limitative example in the accompanying drawings, wherein.

DESCRIPTION OF THE PREFERRED EMBODIMENTS

Figure 1:
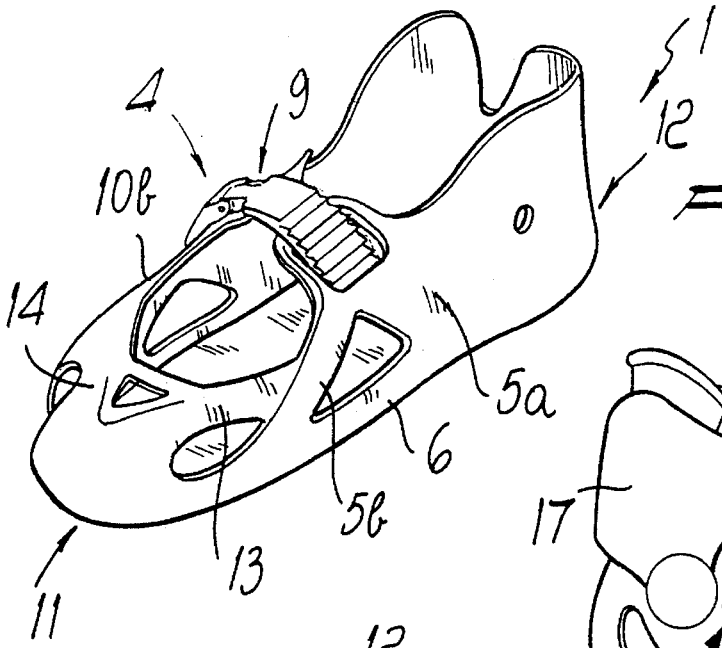
FIG. 1 is a lateral perspective view of the shell.

With reference to the above figures, the reference numeral 1 generally designates a shell that is usable in particular for sports shoes such as for example ice skates or roller skates or trekking boots.

Said shell 1, which is preferably made of plastics, comprises a single body that has a first tab or flap 2 and a second tab or flap 3. At least one of said tabs or flaps is arranged transversely to the foot instep region 4.

In the particular embodiment, the first flap 2 protrudes towards the second flap 3.

Advantageously, the first flap 2 is substantially triangular, with first sides 5*a* and 5*b* that are connected to an edge 6 that laterally surrounds the region 7 where the sole of the foot rests; said sides are mutually connected at a vertex 8 that faces towards the second flap 3.

A single fastening device 9, such as for example a lever that allows to move said first and second flaps mutually closer, is interposed between said vertex 8 and the facing second flap 3.

The second flap 3 is also substantially triangular, with second sides 10*a* and 10*b* that are connected to the lower edge 6 and with a vertex that is directed away from the region 7 where the sole of the foot rests.

Both the first flap and the second flap are thus connected to a vertex along two directrices that are oblique with respect to the toe region 11 and the heel region 12, so as to allow to surround the foot inside the shell in an optimum manner and at the same time allow optimum transmission of forces imparted by the foot along the first and second sides at the single fastening device 9, which thus performs its functions in an optimum manner.

Advantageously, there is also a means for further securing the innerboot in the toe region 11; said means comprises a third flap 13 and a fourth flap 14 that extend from the toe region 11 and connect to one of the first and second sides and particularly to the first side 5*b* and to the second side 10*b*.

Figure 5:
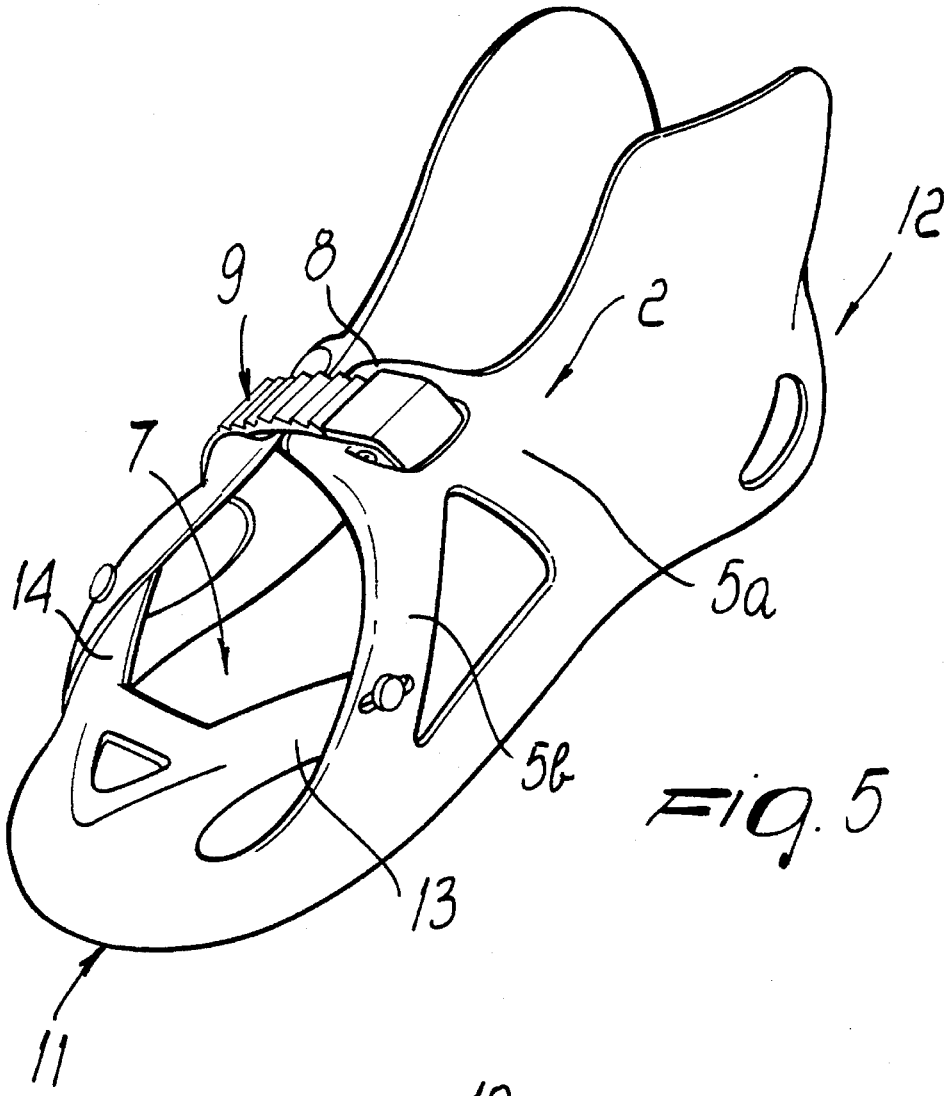
FIG. 5 is a view, similar to FIG. 1, of the fit adapting means.
Figure 6:
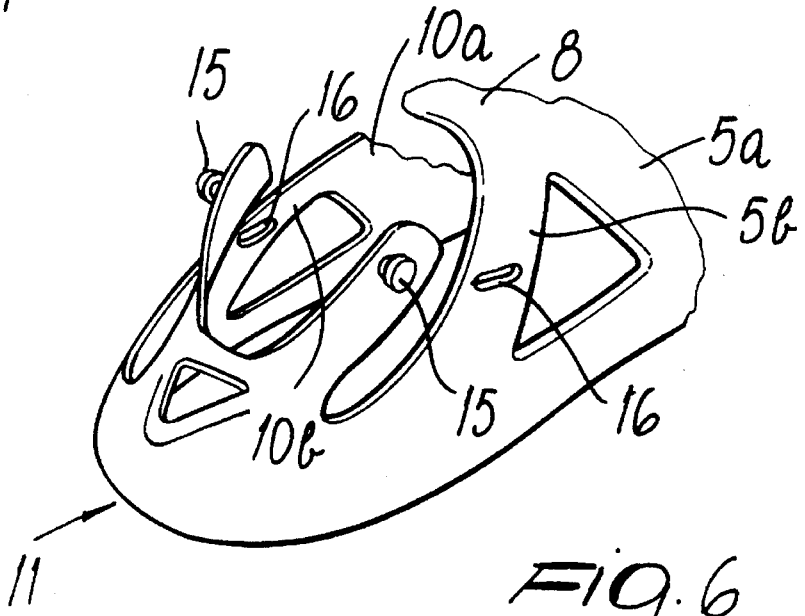
FIG. 6 is a detail view of the means according to FIG. 5.

Connection to said first and second sides can be detachable: in this manner, as shown in FIGS. 5 and 6, the third and fourth flaps have loose ends at which a temporary engagement means 15, such as for example T-shaped studs, is associated. Said engagement means can be positioned at complementarily shaped coupling means 16 constituted by slots formed on said first and second sides.

A fit adaptation means is thus obtained, as the region of the tip of the shell that comprises the third and fourth flaps 13, 14 can slide, during fastening, with respect to the remaining part of the shell. One thus obtains better adaptation to the anatomical shape of the innerboot and, accordingly, better locking of said innerboot inside the shell.

Figure 2:
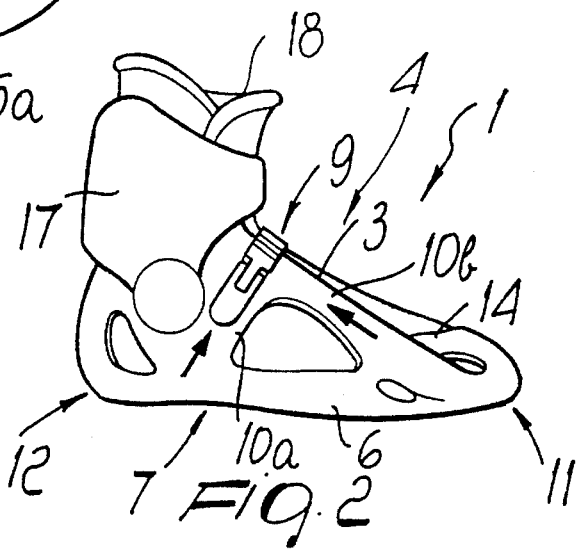
FIG. 2 is a side elevated view of the shell.
Figure 3:
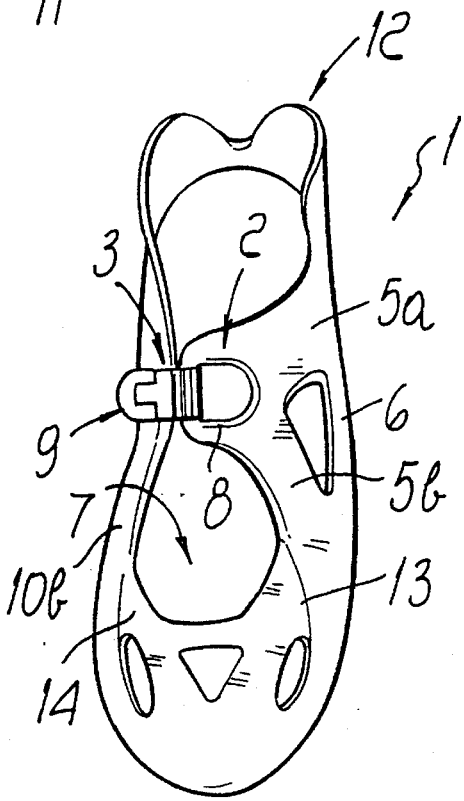
FIGS. 3 and 4 are top views of the shell with the individual fastening device in the maximum and minimum fastening conditions.
Figure 4:
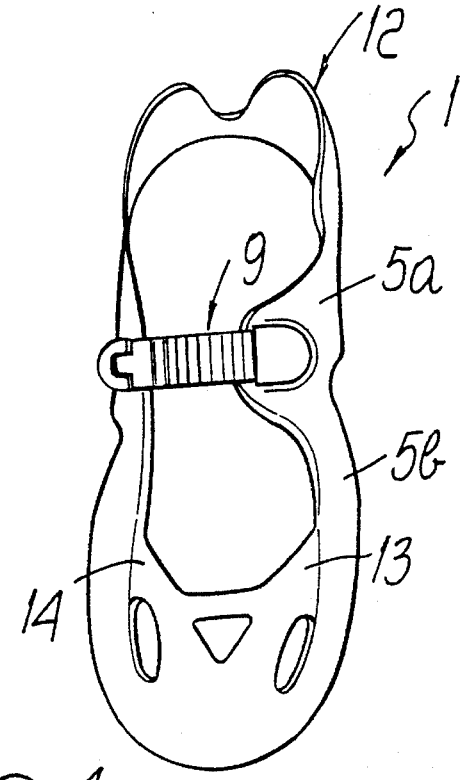

The use of the invention is therefore as follows: once the fastening device 9 has been opened and once an adapted soft innerboot 18 (FIG. 2) has been placed inside the shell 1, the foot accommodated in the innerboot can be fastened in an optimum manner simply by activating the fastening device 9.

In this manner, the first, second, third, and fourth flaps surround the foot in an optimum manner, whereas the shape of the first and second sides allows to achieve optimum securing of the foot, transferring the fastening force applied at the fastening device 9 to the toe and heel regions along directrices that are constituted by the first, second, third, and fourth flaps.

The optional presence of the temporary engagement means and of the complementarily shaped coupling means allows automatic adaptation of the fit according to the anatomical shape of the user's foot.

It is thus evident that the invention has achieved the intended aim and objects, a shell having been obtained that allows to transmit, in an optimum manner, the forces applied by the foot to the wheels and requires the use of a single securing element to perform optimum securing of the foot to the shell, allowing to contain manufacturing costs, to perform a single maneuver to secure or release the foot, and to contain the overall weight of the shoe.

At least one quarter 17 that surrounds the lower part of the leg can also be associated with the shell.

The shell according to the invention is of course susceptible of numerous modifications and variations, all of which are within the scope of the same inventive concept.

The materials and the dimensions that constitute the individual components of the shell may of course also be the most pertinent according to the specific requirements.

What is claimed is:

1. Shell for sports shoes comprising a single body having a first flap and a second flap, at least one of said flaps being arranged transversely to a foot instep region of the shell, a single fastening device being arranged between said flaps, either one of said first and second flaps being connected along two directrices that are oblique with respect to toe and heel regions of the shell, the shell further comprising a third flap and a fourth flap that extend from said toe region and connect respectively to said first flap and said second flap, and wherein said shell is provided with means for adapting the fit in the toe region, said fit adapting means comprising a temporary engagement means which are provided at free ends of said third and fourth flaps, said temporary engagement means being arrangeable at complementarily shaped coupling means formed on said first and second flaps for providing a relative sliding connection between said free ends of said third and fourth flaps and said first and second flaps, wherein said first flap protrudes towards said second flap, said second flap being arranged transversely to the foot instep region of the shell, and wherein said first flap has a substantially triangular shade and comprises first sides that are connected to an edge that surrounds laterally a region where a sole of a user's foot rests and are mutually connected at a vertex that is directed towards said second flap, and wherein said single fastening device comprises a lever that allows said first and second flaps to move mutually closer and is interposed between said vertex and said facing second flap.

2. Shell according to claim 1, wherein said second flap has a substantially triangular shape and comprises second sides which are connected to a lower edge and a vertex which is directed away from said region where the sole of the foot rests.

3. Shell according to claim 2, wherein said first and second sides of said first and second flaps are connected to a respective said vertex along two directrices that are oblique with respect to the toe and heel regions.

4. Shell according to claim 3, wherein said third flap and said fourth flap connect to at least one of said adjacent first and second sides.

5. Shell according to claim 4, wherein the connection between said third and fourth flaps and said first and second sides is detachable, said temporary engagement means comprising T-shaped studs and said complementarily shaped coupling means comprising slots formed on at least one of said first and second sides.

6. A shell for an external connection arrangement about an innerboot in a sports shoe, the shell comprising:

a body having a toe region, a heel region, a sole supporting region, a first lateral side region, a second lateral side region, and a foot instep region;

a first flap arranged at said first lateral side region, said first flap comprising a first lower edge strip, a first forward strip, and a first rearward strip, said first lower edge strip extending upwardly from said sole supporting region, said first forward and rearward strips and said first lower edge strip being mutually interconnected to form a first triangular interconnected arrangement extending about a first lateral hole of said first flap arranged at said first lateral side region, said first forward and rearward strips being mutually interconnected at a first vertex of said first triangular interconnected arrangement;

a second flap arranged at said second lateral side region;

a third flap in the form of a strip element extending from the toe region and connected to said first forward strip of said first flap;

a fourth flap in the form of a strip element extending from the toe region and connected to said second flap; and a single fastening device extending at the foot instep region and being exclusively interconnected between said first vertex of said first flap and a portion of said second flap, said single fastening device being adapted for mutually adjustably and releasably connecting said first vertex of said first flap and said portion of said second flap for closing said shell without requiring use of further fastening means.

7. The shell of claim 6, wherein a portion of said third flap is connected to said first forward strip of said first flap such that said portion of said third flap may freely slide with respect to said first forward strip.

8. The shell of claim 6, wherein said second flap has a triangular formation with a second vertex arranged adjacent said first vertex of said first flap, said portion of said second flap to which said single fastening device is connected being constituted by said second vertex of said second flap.

9. The shell of claim 8, wherein said second flap comprises a second lower edge strip, a second forward strip, and a second rearward strip, said second lower edge strip extending upwardly from said sole supporting region, said second forward and rearward strips and said second lower edge strip being mutually interconnected to form a second triangular interconnected arrangement extending about a second lateral hole of said second flap arranged at said second lateral side region, said second forward and rearward strips being mutually interconnected at said second vertex.

10. The shell of claim 9, wherein said fourth flap in the form of a strip element extends from the toe region and is connected to said second forward strip of said second flap.

11. The shell of claim 10, wherein a portion of said fourth flap is connected to said second forward strip of said second flap such that said portion of said fourth flap may freely slide with respect to said second forward strip.

12. The shell of claim 11, wherein a portion of said third flap is connected to said first forward strip of said first flap such that said portion of said third flap may freely slide with respect to said first forward strip.

13. The shell of claim 9, wherein said forward and rearward strips of said first and second flaps are connected to a respective said vertex along two directrices which are oblique with respect to the toe and heel regions.

14. A shell externally arranged about a sports shoe innerboot, the shell comprising:

a body having a toe region, a heel region, a sole supporting region, a first lateral side region, a second lateral side region, and a foot instep region;

a first flap arranged at said first lateral side region, said first flap comprising a first lower edge strip, a first forward strip, and a first rearward strip, said first lower edge strip extending upwardly from said sole supporting region, said first forward and rearward strips and said first lower edge strip being mutually interconnected to form a first triangular interconnected arrangement extending about a first lateral hole of said first flap arranged at said first lateral side region, said first forward and rearward strips being mutually interconnected at a first vertex of said first triangular interconnected arrangement;

a second flap arranged at said second lateral side region; and a single fastening device extending at the foot instep region and being exclusively interconnected between said first vertex of said first flap and a portion of said second flap, said single fastening device being adapted for mutually adjustably and releasably connecting said first vertex of said first flap and said portion of said second flap for closing said shell about said sports shoe innerboot without requiring use of further fastening means.

15. The shell of claim 14, wherein said first forward and rearward strips of said first flap are connected to said first vertex along two directrices which are oblique with respect to the toe and heel regions.

16. The shell of claim 15, further comprising a third flap in the form of a strip element extending from the toe region and connected to said first forward strip of said first flap.

17. The shell of claim 16, wherein a portion of said third flap is connected to said first forward strip of said first flap such that said portion of said third flap may freely slide with respect to said first forward strip.

18. The shell of claim 17, wherein said second flap comprises a second lower edge strip, a second forward strip, and a second rearward strip, said second lower edge strip extending upwardly from said sole supporting region, said second forward and rearward strips and said second lower edge strip being mutually interconnected to form a second triangular interconnected arrangement extending about a second lateral hole of said second flap arranged at said second lateral side region, said second forward and rearward strips being mutually interconnected at a second vertex of said second triangular interconnected arrangement, the shell further comprising a fourth flap in the form of a strip element which extends from the toe region and is connected to said second forward strip of said second flap, a portion of said fourth flap being connected to said second forward strip of said second flap such that said portion of said fourth flap may freely slide with respect to said second forward strip, and wherein said second forward and rearward strips of said second flap are connected to said second vertex along two directrices which are oblique with respect to the toe and heel regions.

* * * * *